US006563479B2

(12) United States Patent
Weindorf et al.

(10) Patent No.: US 6,563,479 B2
(45) **Date of Patent: *May 13, 2003**

(54) VARIABLE RESOLUTION CONTROL SYSTEM AND METHOD FOR A DISPLAY DEVICE

(75) Inventors: Paul Fredrick Luther Weindorf, Novi, MI (US); Gregory John Milne, South Lyons, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 122 days.

This patent is subject to a terminal disclaimer.

(21) Appl. No.: 09/748,615

(22) Filed: Dec. 22, 2000

(65) Prior Publication Data

US 2002/0113808 A1 Aug. 22, 2002

(51) Int. Cl.[7] ..... G09G 3/30

(52) U.S. Cl. ..... 345/77; 345/50; 345/55; 345/30; 315/169.3

(58) Field of Search ..... 345/77, 50, 55, 345/30, 37–39, 42, 82, 83, 92, 108, 156, 173, 901; 341/146, 159, 172; 455/90, 566; 315/169, 3

(56) References Cited

U.S. PATENT DOCUMENTS 5,206,633 A * 4/1993 Zalph ..... 345/904
5,430,289 A * 7/1995 Erickson et al. ..... 250/205
5,654,764 A * 8/1997 Suh ..... 348/465
5,696,988 A * 12/1997 Dale et al. ..... 341/139
5,798,724 A * 8/1998 Myers ..... 341/146
6,020,868 A * 2/2000 Greene et al. ..... 345/88
6,035,180 A * 3/2000 Kubes et al. ..... 313/509
6,069,598 A * 5/2000 Hansen ..... 345/74.1
6,201,554 B1 * 3/2001 Lands ..... 345/156
6,281,640 B1 * 8/2001 Kim ..... 315/149
6,396,217 B1 * 5/2002 Weindorf ..... 315/169.1
6,411,306 B1 * 6/2002 Miller et al. ..... 345/102

* cited by examiner

*Primary Examiner*—Bipin Shalwala
*Assistant Examiner*—Leonid Shapiro
(74) *Attorney, Agent, or Firm*—Brinks Hofer Gilson & Lione

(57) ABSTRACT

This invention provides a resolution control system for a display device, which may have a lighted display and control circuitry. The lighted display may be backlit, frontlit, or emissive. The resolution control system may have two or more digital-to-analog converters, which may be provided by digital-to-analog converter (DAC) circuitry in the control circuitry. The DACs convert data values into an output voltage for controlling an operating parameter, which may be brightness, contrast, and the like. The DACs have a cascade arrangement where the output voltage of one DAC is the input voltage of another DAC.

47 Claims, 2 Drawing Sheets

VARIABLE RESOLUTION CONTROL SYSTEM AND METHOD FOR A DISPLAY DEVICE

CROSS REFERENCE TO RELATED APPLICATIONS

The following co-pending and commonly assigned U.S. patent applications have been filed on the same day as this application. All of these applications relate to and further describe other aspects of the embodiments disclosed in this application and are incorporated in this application by reference in their entirety.

U.S. patent application Ser. No. 09/747,597, "AUTOMATIC BRIGHTNESS CONTROL SYSTEM AND METHOD FOR A DISPLAY DEVICE USING A LOGARITHMIC SENSOR," filed on Dec. 22, 2000.

U.S. patent application Ser. No. 09/748,528, "BRIGHTNESS OFFSET ERROR REDUCTION SYSTEM AND METHOD FOR A DISPLAY DEVICE," filed on Dec. 22, 2000, and is now U.S. Pat. No. 6,396,217.

FIELD OF THE INVENTION

This invention generally relates to display devices. More particularly, this invention relates to display devices having resolution control systems for one or more operating parameters.

BACKGROUND OF THE INVENTION

Display devices are used in a variety of consumer and industrial products to display data, charts, graphs, messages, other images, information, and the like. Backlight display devices, which may be backlit or frontlit, have a backlight positioned to provide light for a display panel. Emissive display devices have pixels that are the emissive light source. In emissive displays, the pixel light source may be a CRT phosphor, a FED phosphor, a light emitting diode (LED), an organic LED, an electroluminescent, or any emissive display technology. In backlight display devices, the backlight may be a fluorescent tube, an electroluminescent device, LED, a gaseous discharge lamp, a plasma panel, and the like. The display panel may be a passive or active matrix liquid crystal display (LCD). The backlight and display panel are connected to control circuitry, which is connected to a voltage supply. The display device may be separate or incorporated with other components, such as a dashboard in an automobile or other vehicle, a portable electronic device, and the like.

Many display devices control operating parameters in relation to user preferences and the environment of the display device. These operating parameters include the brightness, contrast, color, tint, and the like. Some parameters remain at an essentially fixed level for an extended time period. Other parameters change frequently because of changes in the environment, user preferences, and similar factors. The control circuitry may automatically adjust one or more parameters in relation to changing environmental conditions of the display device. A user may further adjust or manually set one or more parameters through a user interface such as a knob, switch, keypad, touch screen, remote device, or the, like.

Each operating parameter typically may have multiple adjustment steps for changing the operating level. The adjustment steps may be arranged in an adjustment sequence, having a linear progression from the lowest to the highest operating levels for the parameter. The number of adjustment steps may depend upon the dynamic range of the display device. A wide dynamic range generally needs more adjustment steps than a narrow dynamic rage. The dynamic range corresponds to the use of the display device. A narrow dynamic range may cover one or a small number of uses such as daylight use, nighttime use, or the like. A wide dynamic range may cover several uses such as daylight use, nighttime use, dusk-to-dawn use, and the like. The number of adjustment steps also may depend on the desired resolution of the parameter. More adjustment steps generally provide more resolution than less adjustment steps with sufficient resolution. Other factors may increase the number of adjustment steps.

Many display devices support a large number of adjustment steps for one or more operating parameters. Applications with wide dynamic ranges usually provide sufficient adjustment steps to cover the ranges of use. In automotive applications, a display device may be used in a multitude of ambient light conditions ranging from bright, sunny days to dark, "moonless" nights and the like. Other applications also may have wide dynamic ranges.

In addition, some operating parameters may require variable resolution control. Parameters like brightness require variable resolution because of how a human eye perceives changes in operating levels of the parameter. The human vision system perceives changes in brightness and like parameters non-linearly and logarithmically. A user perceives a brightness change from about 10 nits to about 12 nits as essentially equal to a brightness change from about 100 nits to about 120 nits. As the brightness level decreases, more brightness control resolution provides brightness step changes perceived as uniform by a user. Thus, a backlight or emissive display device needs more brightness resolution at lower brightness levels and less brightness resolution at higher brightness levels. This variable resolution requirement unnecessarily increases the number of quantized levels that must be made available from the control circuit if accomplished in a linear manner, such as with a single digital to analog converter.

To change or adjust the operating level of a parameter, the control circuitry receives an input signal indicating a user preference, an environmental condition, a combination, or the like. The control circuitry uses the input signal to select an operating value of the parameter. For brightness, the operating value is a luminance value. A digital-to-analog converter (DAC) may be used to convert the operating value into an analog control signal or an output voltage, such as a command brightness signal. The control circuitry provides the analog control signal to the backlight, the display panel, or both, depending on the parameter. The control circuitry may modify or further adjust the analog control signal and may combine the analog control signal with other inputs to operate the display device at the desired level for the parameter.

The control circuitry typically has a single DAC or PWM plus a filter to convert the digitized control signal into the analog control signal. For some operating parameters, a high resolution DAC may be used to provide sufficient adjustment resolution for the lower levels. For brightness and similar operating parameters, an even larger DAC is used to provide an output signal and to reduce errors from quantizing the operating value. A DAC for brightness control may have 12 bits of resolution for use in a dynamic range of about 0.5 nits through about 400 nits. The higher resolution DAC may increase the cost of the display device. While the digital data input into the DAC typically has a linear progression, the analog control signals from the DAC need to have constant ratio steps or an exponential progression for a user to perceive uniform adjustment steps.

SUMMARY

This invention provides variable resolution control of an operating parameter for a display device or any other device that requires more resolution at lower control variable levels. The operating parameter may be brightness, contrast, and the like. Two or more digital-to-analog converters or similar devices convert data values or digitized control signals into analog control signals or output voltages for controlling the operating parameter. The two or more digital-to-analog converters have a cascade arrangement.

In one aspect, a display device has digital-to-analog converter (DAC) circuitry connected to a lighted display panel. The DAC circuitry has at least a first DAC and a second DAC. The first DAC is operatively connected to provide a first output voltage to the second DAC. The second DAC is operatively connected to provide a second output voltage to the lighted display. The second output voltage is responsive to the first output voltage.

In another aspect, a resolution control system has a first DAC and a second DAC. The first DAC has a first voltage output, a first data input value, and a reference voltage input. The second DAC is operatively connected to receive the first voltage output of the first DAC. The second DAC has a second voltage output, a second data input, and an input for the first voltage output.

In a method for controlling the resolution of an operating parameter, a first data input value and a second data input value are provided. The first data input is converted into a first output voltage as a function of a reference voltage. The second data input is converted into a second output voltage as a function of the first output voltage.

In another method for controlling the resolution of an operating parameter a control signal is generated with at least two cascaded digital-to-analog converters. A parameter of a display device is controlled in response to the control signal.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION OF THE PREFERRED EMBODIMENTS

Figure 2:
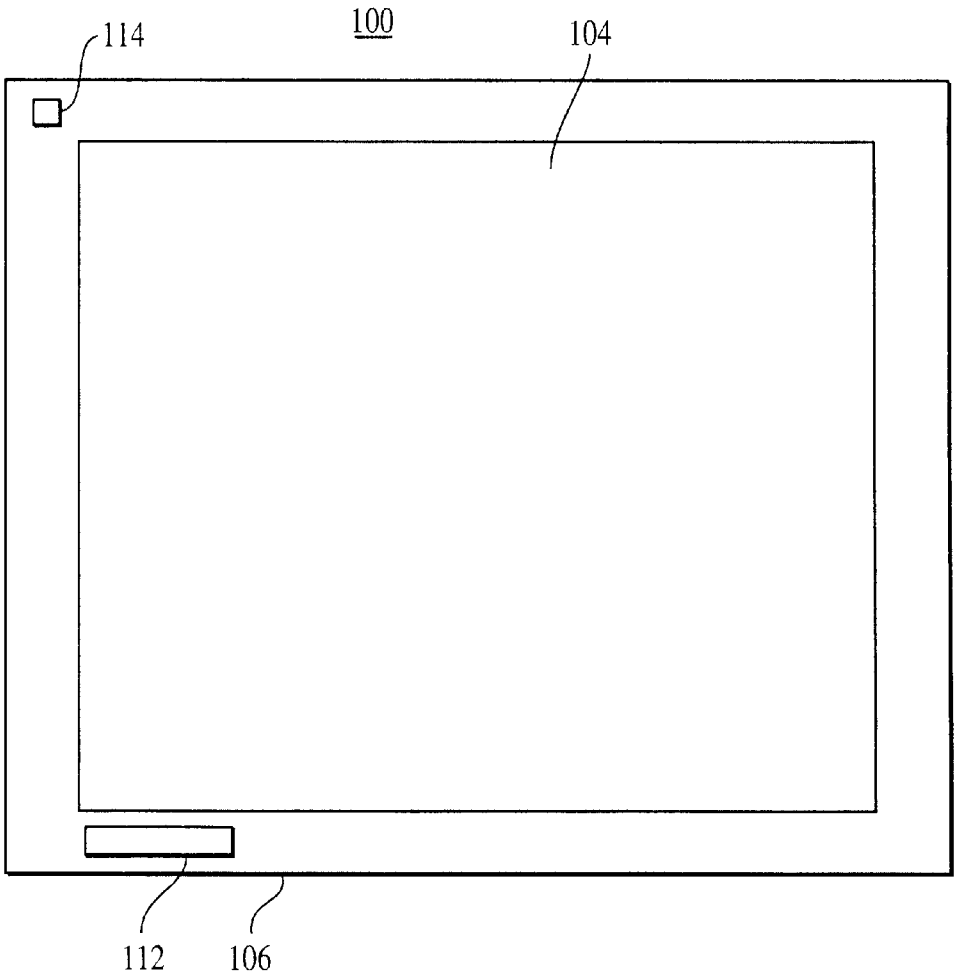
FIG. 2 represents a front view of the backlight display device shown in FIG. 1.
Figure 1:
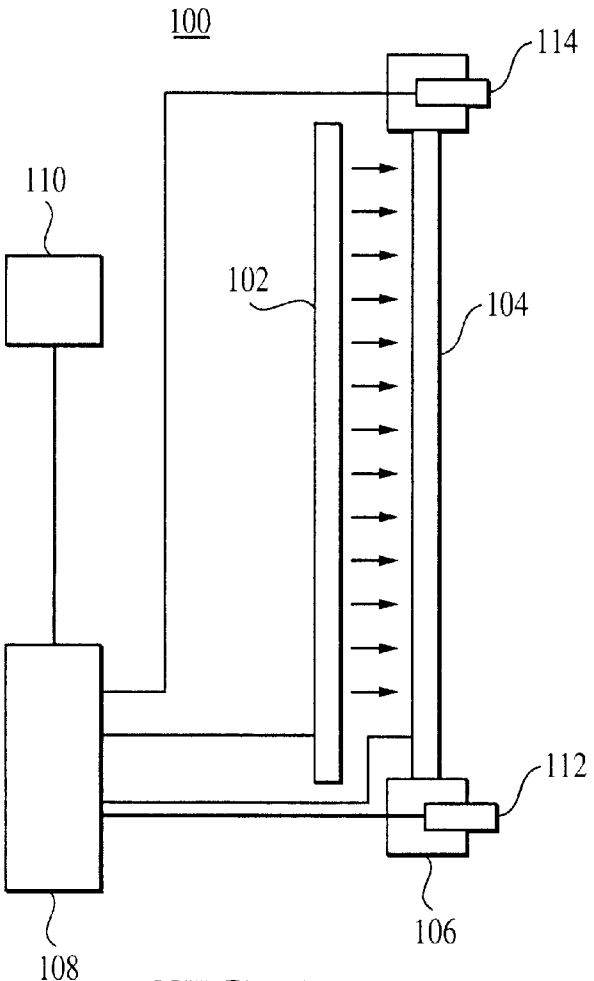
FIG. 1 represents a side view of a backlight display device having an automatic brightness control system according to one embodiment.

FIGS. 1 and 2 represent block diagrams of a backlight display device 100 having a variable resolution control system according to one embodiment. FIG. 1 shows a side view of the backlight display device 100. FIG. 2 shows a front view of the backlight display device 100. In one aspect, the variable resolution control system controls the brightness of the backlight display device 100. The resolution control system may control other operating parameters such as contrast, the like, and other parameters requiring more resolution at lower output values.

In this embodiment, the backlight display device 100 has a backlight 102, a display panel 104, a bezel 106, control circuitry 108, a voltage supply 110, a user interface 112, and an ambient light sensor 114. The backlight display device 100 may have additional or fewer components and may have different configurations. The backlight display device 100 may provide a reverse image for rear projection, may project an image onto a display surface (not shown), may have one or more magnification lens (not shown) and reflective surfaces (not show), may work with or have other components, and the like.

The backlight display device 100 may be incorporated in a navigation radio system for an automobile or other vehicle. The backlight display device 100 may be built-in or integrated with a dashboard, control panel, or other part of an automobile or other vehicle. The backlight display device 100 also may be built-in or integrated with an electronic device, such as a cell phone or other communication device, a laptop or other personal computer, a personal organizer, and the like. Additionally, the backlight display device 100 may be separate or a separable component. While configurations and modes of operation are described herein, other configurations and modes of operation may be used.

In one aspect, the backpanel 102 and the display panel 104 form a liquid crystal display (LCD). The backpanel 102 and the display panel 104 may be a passive or active matrix LCD and may comprise another type of lighted display, which may be a backlit or front lit display and may be an emissive display such as an LED or other pixel light source. In this embodiment, the backpanel 102 is operatively disposed to provide light for operation of the display panel 104. The backpanel 102 and the display panel 104 may provide monochrome, color, or a combination of monochrome and color displays. In this embodiment, the backpanel 102 is a cold cathode fluorescent lamp. The backpanel 102 may be one or more fluorescent tubes, electro-luminescent devices, gaseous discharge lamps, LEDs, plasma panels, a combination, and the like, which may be aligned. The backpanel 102 may include multiple or sub backlights. The display panel 104 may be selected based on the type of backlight and may have multiple or sub display panels.

The bezel 106 may extend around and hold the outer perimeter of the display panel 104. The bezel 106 may have various configurations and may extend around part or only a portion of the outer perimeter. The bezel 106 may hold or extend around other components, such as the backpanel 102. The bezel 106 also may include additional bezels and may be connected with or be part of another component such as a dashboard in an automobile.

The control circuitry 108 provides an image signal to the backpanel 102 and/or the display panel 104. The control circuitry 108 may include one or more microprocessors (not shown) and may be part or incorporated with other circuitry such as a central processing unit or a vehicle control unit. The control circuitry 108 may be partially or completely provided on one or more integrated circuit (IC) chips.

The control circuitry 108 may have other circuitry for control and operation of the backlight display device 100 such as a transceiver, one or more memory devices, and the like. The control circuitry 108 also is connected to a voltage supply 110, which may be provided by an automotive battery or electrical system, another type of battery, a household current supply, or other suitable power source.

The control circuitry 108 may generate the image signal and may pass the image signal from another source (not shown). The image signal may be based upon one or more radio signals, one or more signals from a global positioning system (GPS), data stored in a memory device, user inputted data, or a combination or combinations of these signals and data.

Along with or as part of the image signal, the control circuitry 108 provides one or more operating parameters or signals to control the display panel 104. Operating parameters include brightness, contrast, and the like. In one aspect, the operating parameter is the brightness or luminance of the display panel 104. In this aspect, the control circuitry 108 provides a command brightness signal or output voltage that corresponds to a luminance value or brightness for the display panel 104. The command brightness signal changes as different luminance values are used. The other operating parameters may be controlled or adjusted similar to or different than the brightness.

To adjust or control an operating parameter, the control circuitry 108 receives an input signal or signals indicating a user preference, an environmental condition, other factors, or a combination of factors. For brightness, the input signal may indicate the ambient light condition of the display panel 104. The user interface 112, the ambient light sensor 114, and other input devices may provide the input digital or analog signal. The control circuitry 108 selects an operating value based on the input signal or signals. The operating value corresponds to a desired or selected level of the operating parameter. For brightness, the operating value may be a luminance value in the range of about 0.5 nits through about 400 nits. Other displays may have different luminance ranges.

The control circuitry has digital-to-analog converter (DAC) circuitry to convert the operating value into an analog control signal or output voltage such as a command brightness signal for controlling the operating level of the parameter. The DAC circuitry may be a part or separate from the control circuitry 108. The DAC circuitry may be provided on one or more integrated circuit (IC) chips. The control circuitry provides the analog control signal to the backpanel 102, the display panel 104, or both, depending on the parameter. The backlight may include an inverter (not shown). The control circuitry 108 may modify or further adjust the analog control signal and may combine the analog control signal with other inputs to operate the backlight display device 100 at the operating levels for the parameter.

The user interface 112 enables a user to interact with the backlight display device 100. The user may adjust various aspects of the display including contrast, brightness, and the like. The user interface 112 may provide an input digital or analog signal to the control circuitry 108 indicating a user preference or selection for operation of the backlight display device 100. For brightness, the user preference may be nighttime, daytime, a manual selection, and the like. In one aspect, the user interface 112 is disposed in or on the outer surface of the bezel 106. The user interface 112 may be one or more knobs or push buttons. The user interface 112 also may be other types of manual controls, a touch screen, electronic input from another device, and the like. The user interface 112 may be located elsewhere, may be incorporated with another controller or user interface, and may be included in a remote control device.

The ambient light sensor 114 is connected to the control circuitry 108 and is disposed to provide an input signal indicative of the ambient light on the display panel 104. The ambient light sensor 114 may include a photodiode (not show) and may be a logarithmic sensor or another type of sensor. The ambient light sensor 114 may have a logarithmic amplifier (not shown), other components, and other configurations. The logarithmic amplifier may be part of the control circuitry 108. In this aspect, the ambient light sensor 114 or the photodiode is positioned on an outer surface of the bezel 106. The ambient light sensor 114 or the photodiode may be placed elsewhere.

The ambient light sensor 114 may be temperature compensated and may discriminate between daytime and nighttime conditions for determination of display luminance and control functions. Daytime conditions have ambient light levels in the range of light levels from dawn until dusk. The ambient light sensor 114 may operate in a dynamic range of lighting conditions such as those encountered in the automotive environment. The ambient light sensor 114 may have a dynamic range of about four decades of lighting conditions. In one aspect, the ambient light sensor 114 operates on less than about five volts from a single positive power supply. The ambient light sensor 114 may operate on other voltage ranges and with positive and negative supplies.

In one aspect for controlling the brightness of the backlight display device 100, the ambient light sensor 114 senses ambient light. A photodiode in the ambient light sensor 114 provides an analog sensor signal. A logarithmic amplifier amplifies the analog sensor signal to provide an input sensor signal. The control circuitry 108 may have an analog-to-digital converter (not shown) to digitize the input sensor signal, which may be filtered or averaged. The control circuitry 108 uses the input sensor signal to select or provide a brightness or luminance value to the digital-to-analog converter (DAC) circuitry. The DAC circuitry converts the luminance value into an output voltage or command brightness signal for controlling the luminance or brightness of the display panel 104.

Figure 3:
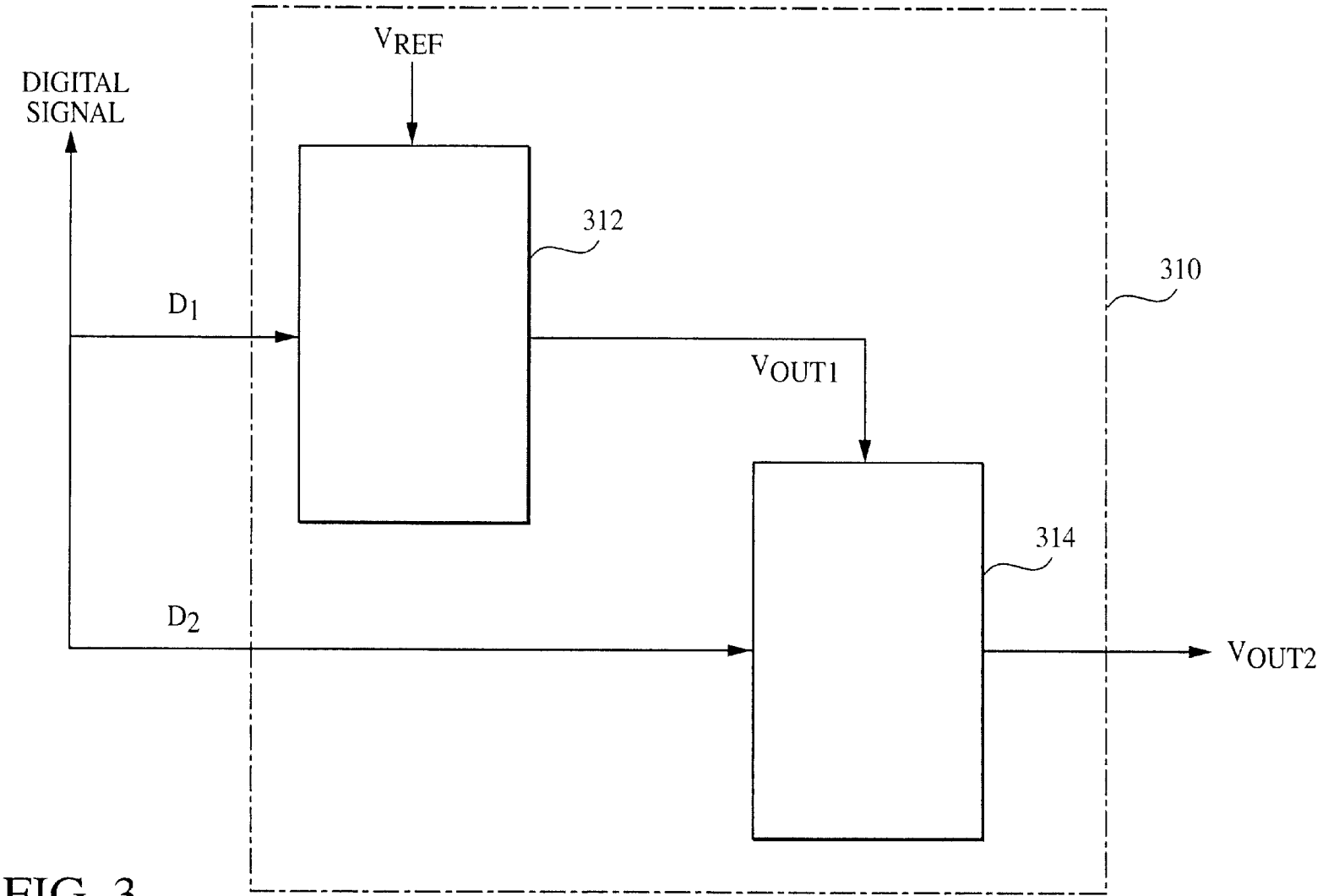
FIG. 3 represents a block diagram and flowchart of digital-to-analog converter (DAC) circuitry for a display device.

FIG. 3 represents a block diagram and flowchart of digital-to-analog converter (DAC) circuitry 310 for a display device. The DAC circuitry 310 has a first DAC 312 operatively connected to a second DAC 314. Operatively connected includes direct and indirect connections sufficient to provide an output signal or voltage from one DAC to another DAC. The indirect connections may be through or include other circuitry (not shown). The other circuitry may be one or more DACs (not shown). The output signal or voltage of either DAC 312, 314 may be combined with other inputs.

The first DAC 312 is responsive to a first number of data bits $N_1$. The second DAC 314 is responsive to a second number of data bits $N_2$. The first number of data bits $N_1$, and the second number of data bits $N_2$ may be the same and may be different. In one aspect, the first number of data bits $N_1$, and the second number of data bits $N_2$ are each eight bits. The size of either DAC 312 and 314—the number of data bits $N_1$, and $N_2$ respectively—may be based upon the dynamic range of the display device and other factors. The size of either DAC 312 and 314 may be based upon the maximum resolution of the brightness or other operating parameters.

As previously discussed, the control circuitry provides a luminance or other operating value to the DAC circuitry 310. The luminance or operating value corresponds to the desired or selected operating level of the brightness or other parameter for the display device. In one aspect, the control circuitry 108 uses the luminance or operating value to provide a first digital data input value $D_1$ to the first DAC 312 and a second digital data input value $D_2$ to the second DAC 314. Based on a reference voltage $V_{REF}$ provided by the control circuitry 108, the first DAC 312 provides a first output voltage $V_{OUT1}$ corresponding to the first digital data input value $D_1$. The reference voltage $V_{REF}$ may be any voltage suitable for operating the control circuitry and the display device. The reference voltage $V_{REF}$ may correspond to the voltage supply of an automobile, another vehicle, or another generated supply voltage. In one aspect, the reference voltage $V_{REF}$ is less than about 5 volts. In another aspect, the reference voltage $V_{REF}$ is in the range of about 2.8 volts through about 3.8 volts. In yet another aspect, the reference voltage $V_{REF}$ is about 3.3 volts.

The first DAC 312 divides the reference voltage $V_{REF}$ into $2^{N_1}$, (256 in this embodiment) coarse voltages, which may have an increasing linear progression. One of the coarse voltages is selected as the first output voltage $V_{OUT1}$ in response to the first digital data input value $D_1$. The first DAC 312 provides the first output voltage $V_{OUT1}$ to the second DAC 314 as an input voltage.

Based on the first output voltage $V_{OUT1}$, the second DAC 314 provides a second output voltage $V_{OUT2}$ corresponding to the second digital data input value $D_2$.

The second DAC 312 divides the first output voltage $V_{OUT1}$ into $2^{N_2}$ (256 in this embodiment) fine voltages, which may have an increasing linear progression. The second digital data input value $D_2$ essentially selects one of the fine voltages as the second output voltage $V_{OUT2}$. In this embodiment, the control circuitry provides the second output voltage $V_{OUT2}$ as the command brightness signal for controlling the brightness of the display device.

This cascade arrangement of the first and second DACs 312 and 314 may use first and second digital data input values $D_1$ and $D_2$ having linear progressions. A cascade arrangement includes one DAC providing an output voltage as the input voltage into another DAC. The values of the second output voltage $V_{OUT2}$ may provide constant ratio steps or an exponential or other non-linear progression for brightness or another operating parameter. A constant ratio step is when the ratio of a first pair of sequential second output voltages is essentially the same as the ratio of a second pair of sequential second output voltages. The first and second pairs may have a common second output voltage. Constant ratio steps provide resolution control of brightness that more closely corresponds to the capability of the human visual system to perceive changes in brightness.

The values of the second output voltage $V_{OUT2}$ may provide variable resolution for an operating parameter. Variable resolution may comprise the capability of providing quantized values in smaller increments at one end (i.e., the bottom) of the scale and progressing to larger quantized incremental values at the other end (i.e., the top) of the scale or dynamic range. Variable resolution also may comprise a non-linear sequence or progression of quantized values available for a parameter. The sequence may have more quantized adjustment steps at lower operating levels, than at higher operating levels.

The human system logarithmically perceives constant ratio luminance steps, which are non-linear and exponential, as equal brightness steps. A brightness change from 1 nit to 1.2 nits is perceived as equal to a brightness change from 100 nits to 120 nits (both changes have a constant ratio step of about 1.2 or its inverse). A user perceives brightness or luminance adjustments with essentially constant ratio steps as equal brightness changes. The nonlinear, logarithmic response of the eye allows the visual system to work over many orders of magnitude. Similarly, a brightness control system with a constant ratio may work over many orders of magnitude.

In this embodiment, the second output voltage $V_{OUT2}$ from the second DAC 314 is controlled by the data input values of the first DAC 312 and second DAC 314 as shown by the following equation:

$$V_{OUT2} = \frac{(V_{REF})(D_1)(D_2)}{(2^{N_1})(2^{N_2})} \quad \text{(Eqn. 1)}$$

where $V_{OUT2}$ is the output voltage from the second DAC 314 and is proportional to the output brightness B, $V_{REF}$ is the reference voltage provided to the first DAC 312, $D_1$ is the digital data input value for the first DAC 312, $D_2$ is the digital data input value for the second DAC 314, $N_1$, is the number of data bits for the first DAC 312, and $N_2$ is the number of data bits for the second DAC 314. In this embodiment, $N_1$, and $N_2$ both have eight bits.

In one aspect, $D_1$ is selected as the lowest value for obtaining the desired output voltage. $D_1$ may be calculated by the following equation:

$$D_1 = TRUNC\left[\frac{V_{SEL} \cdot 2^{N_1}}{V_{REF}}\right] + 1 \quad \text{(Eqn. 2)}$$

where $V_{SEL}$ is the desired output voltage from the second DAC 314 and the TRUNC function truncates the fractional part of the result.

$D_2$ may be calculated by the following equation:

$$D_2 = ROUND\left[\frac{V_{SEL} \cdot 2^{N_1} \cdot 2^{N_2}}{D_1 \cdot V_{REF}}\right] \quad \text{(Eqn. 3)}$$

Where the ROUND function rounds the result to the closest integer value.

Equation 3 may be used to calculate the resolution, which may be represented by the difference between the output voltage $\Delta V_{OUT2}$, at the lowest brightness level (i.e., when $D_1$ is equal to 1) as follows:

$$\Delta V_{OUT2} = \frac{V_{REF}}{2^{(N_1+N_2)}} \quad \text{(Eqn. 4)}$$

Equation 3 also may be used to calculate the resolution at the highest brightness level (i.e., when $D_1$ is equal to $2^{N_1}$) as follows:

$$\Delta V_{OUT2} = \frac{V_{REF}}{2^{N_2}} \quad \text{(Eqn. 5)}$$

In this aspect, the resolution at low brightness levels increases by a factor of $2^{N_1}$, from the highest brightness levels. The $\Delta V_{OUT2}$ resolution may be calculated by the following equation:

$$\Delta V_{OUT2} \cong \frac{V_{OUT2}}{2^{N_2}} \quad \text{(Eqn. 6)}$$

The relationship required for brightness control may be derived using the following equation:

$$\frac{B_{N+1} \pm \Delta B/2}{B_N} = R \pm \frac{(R)(\%E)}{100} \quad \text{(Eqn. 7)}$$

where ΔB/2 is the maximum error caused by the quantum steps of the DAC. $B_{N+1}$ is the desired brightness level above the previous brightness level $B_N$ and to maintain constant ratio steps R for the brightness, and %E is the maximum allowed error in the brightness step ratios over the dynamic brightness range.

Solving for ΔB provides the following equation that relates the DAC maximum quantum step value to the brightness level:

$$\Delta B = \frac{2(B_N)(R)(\%E)}{100} \quad \text{(Eqn. 8)}$$

Equation 8 shows the DAC quantum value ΔB must decrease linearly as the brightness level decreases. The cascade arrangement of the DACs may provide this linear relationship.

In one embodiment, the brightness control system requires 21 nighttime brightness steps ranging from 0.5 nits to 60 nits and a daytime maximum brightness of 400 nits. The nighttime constant ratio step RN may be derived using the following equation:

$$R_N = (B_{MAX}/B_{MIN})^{(1/(N-1))} = (60/0.5)^{(1/(21-1))} = 1.27 \quad \text{(Eqn. 9)}$$

When the maximum ratio error %E is 10%, the maximum DAC quantum step ΔB required at the 0.5 nits level may be calculated using Equation 8 as follows:

$$\Delta B = \frac{2(0.5)(1.27)(10)}{100} = 0.127 \text{ nits} \quad \text{(Eqn. 10)}$$

If a single DAC was used as in the prior art, the single DAC would have a dynamic range from about 0.5 nits through about 400 nits. The resolution required by a single DAC may be calculated using the following equation:

$$\frac{\Delta B}{400} = \frac{1}{2^N} \quad \text{(Eqn. 11)}$$

The number of data bits required by a single DAC may be calculated using the following equation:

$$N = \frac{\log(400/\Delta B)}{\log(2)} = 11.62 \text{ bits} \quad \text{(Eqn. 12)}$$

The 11.62 bits may be rounded up to a 12-bit DAC.

In contrast, the first DAC 312 and the second DAC 314 are eight-bit DACs in this embodiment. The effective ΔB resolution may be calculated using equation 2 as follows:

$$D_1 = TRUNC\left[\frac{5 \cdot 2^8}{400}\right] + 1 = 1 \quad \text{(Eqn. 13)}$$

The DAC quantum step ΔB when $D_1$ is equal to 1 may be calculated as follows:

$$\Delta B = \frac{400}{(2^8)(2^8)} = 0.0061 \text{ nits} \quad \text{(Eqn. 14)}$$

The resolution provided by the cascade arrangement of the first DAC 312 and the second DAC 314 is about 20 times greater than the resolution provided by a single 12-bit DAC. The two eight-bit DACs may cost less than the single 12-bit DAC.

In one aspect, the DAC circuitry 310 may have one or more DACs (not shown) in addition to the first DAC 312 and the second DAC 314. The one or more DACs may be operatively connected to each other and to the first and second DACs 312 and 314. The DACs form a cascade arrangement as previously discussed. The one or more DACs may form one or more intermediate DACs in between the first DAC 312 and the second DAC 314. One or more intermediate data input values are provided to the one or more intermediate DACs, which provide an intermediate output voltage to the second DAC 314.

The one or more DACs also may extend sequentially starting with a third DAC operatively connected to the second DAC 314. The first and second DACs 312 and 314 are connected and operate as previously discussed. The digitized command brightness signal provides additional digital data input values that correspond to the number of additional DACs in the DAC circuitry 310. The second DAC 314 provides the second output voltage $V_{OUT2}$ as the input voltage to the third DAC, which provides an output voltage as the input voltage to any following DAC, and so on. The control circuitry provides the output voltage of the third or last DAC as the command brightness signal for controlling the brightness of the display device. The additional DACs may further increase the resolution as previously discussed.

The cascade arrangement of two or more DACs may be used to provide a variable resolution brightness control system having more resolution control at lower brightness levels and less resolution control at higher brightness levels. The cascade arrangement also may reduce any offset errors of the DACs. As the brightness level decreases, more brightness resolution is provided so the brightness step changes are uniform to a user. Additionally, the variable resolution brightness system may work over many orders of luminance magnitude.

Various embodiments of the invention have been described and illustrated. However, the description and illustrations are by way of example only. Many more embodiments and implementations are possible within the scope of this invention and will be apparent to those of ordinary skill in the art. For example, different or additional display characteristics may be controlled with multiple DACs. The variable resolution control may be used with any other device that requires more resolution at lower control variable levels such as volume control. Therefore, the invention is not limited to the specific details, representative embodiments, and illustrated examples in this description. Accordingly, the invention is not to be restricted except in light as necessitated by the accompanying claims and their equivalents.

What is claimed is:

1. A display device having a resolution control system, comprising:

a lighted display; and digital-to-analog converter (DAC) circuitry comprising at least a first DAC and a second DAC, the first DAC operatively connected to provide a first output voltage to the second DAC, where the first DAC divides a reference voltage into coarse voltages, where the first DAC selects one of the coarse voltages as the first output voltage in response to a first data input value, and the second DAC operatively connected to provide a second output voltage to the lighted display, the second output voltage responsive to the first output voltage where the second DAC divides the first output voltage into fine voltages, where the second DAC selects one of the fine voltages as the second output voltage in response to a second data input value.

2. The display device according to claim 1, where the lighted display further comprises:

a display panel; and a backlight operatively disposed adjacent to the display panel.

3. The display device according to claim 2, where the display panel is an active matrix liquid crystal display.

4. The display device according to claim 2, where the backlight comprises at least one of a cold cathode fluorescent lamp, an electro-luminescent lamp, and a light emitting diode (LED).

5. The display device according to claim 2, where the second DAC provides the second output voltage to at least one of the display panel and the backlight.

6. The display device according to claim 1, where the lighted display is a backlit display.

7. The display device according to claim 1, where the lighted display is a frontlit display.

8. The display device according to claim 1, where the lighted display is an emissive display.

9. The display device according to claim 1, where the lighted display comprises a pixel light source.

10. The display device according to claim 9, where the pixel light source comprises a light emitting diode.

11. The display device according to claim 1, where the first output voltage is based on a first data input value and a reference voltage, where the second output voltage is based on a second data input value.

12. The display device according to claim 11, where the control circuitry selects at least one of the first and second data input values from data input values having a linear progression, and where the second output voltage provides constant ratio steps.

13. The display device according to claim 11, where the first and second data input values provide an operating value for a parameter, and where the second output voltage corresponds to the operating value.

14. The display device according to claim 13, where the parameter is one of brightness and contrast.

15. The display device according to claim 1, where at least one of the first DAC and the second DAC has 8 bits of resolution.

16. The display device according to claim 1, where the first DAC is responsive to a first plurality of data bits and the second DAC is responsive to a second plurality of data bits, where at least one of the first and second pluralities of data bits is based on a dynamic range, and where at least one of the first and second pluralities of data bits is based on a resolution of an operating parameter.

17. The display device according to claim 16, where the dynamic range accounts for operation during at least one of daytime, nighttime, dusk, and dawn, and the operating parameter is brightness.

18. The display device according to claim 11, where the reference voltage is generated from the voltage supply of a vehicle.

19. The display device according to claim 1, further comprising:

a light sensor disposed to sense ambient light on the lighted display; and control circuitry connected to receive an input signal from the light sensor, where the control circuitry selects the first and second data input values in response to the input signal, the first and second data inputs corresponding to an operating parameter.

20. The display device according to claim 19, where the light sensor is a logarithmic sensor.

21. The display device according to claim 1, further comprising:

a user interface control circuitry connected to receive an input signal from the user interface, where the control circuitry selects the first and second data input values in response to the input signal, the first and second data inputs corresponding to an operating parameter.

22. The display device according to claim 1, where the DAC circuitry comprises at least one integrated circuit (IC) chip.

23. The display device according to claim 1, where the display device comprises a display of a navigation radio.

24. The display device according to claim 1, where the display device comprises a display of an electronic device.

25. The display device according to claim 1, where the electronic device is one of a communication device, a personal computer, and a personal organizer.

26. A resolution control system for a display device, comprising:

a first digital-to-analog converter (DAC) comprising a first voltage output, a first data input, and a reference voltage input; where the first DAC divides a reference voltage into coarse voltages, where the first DAC selects one of the coarse voltages as a first output voltage in response to a first data input value, and a second digital-to-analog converter (DAC) operatively connected to the first voltage output from the first DAC, the second DAC comprising a second voltage output, a second data input, and an input for first voltage output, where the second DAC divides the first output voltage into fine voltages, where the second DAC selects one of the fine voltages as a second output voltage in response to a second data input value.

27. The resolution control system according to claim 26, where the first DAC and second DAC have an equal number of data bits of resolution.

28. The resolution control system according to claim 27, where the number of data bits is about eight.

29. The resolution control system according to claim 26, where the first DAC is responsive to a first plurality of data bits and the second DAC is responsive to a second plurality of data bits, where at least one of the pluralities of data bits is based on a dynamic range, and where at least one of the pluralities of data bits is based on a resolution of an operating parameter.

30. The resolution control system according to claim 26, where the reference voltage input is less than about 5 volts.

31. The resolution control system according to claim 26, where the reference voltage input is in the range of about 2.8 volts through about 3.8 volts.

32. The resolution control system according to claim 26, where the reference voltage input is about 3.3 volts.

33. The resolution control system according to claim 26, where the first and second data inputs provide an operating value for a parameter, and where the second output voltage corresponds to the operating value.

34. The resolution control system according to claim 33, where the parameter is one of brightness and contrast.

35. The resolution control system according to claim 33, where the operating value is a luminance value, and where the operating parameter is brightness.

36. The resolution control system according to claim 35, where the luminance value is in the range of about 0.5 nits through about 400 nits.

37. The resolution control system according to claim 26, where at least one of the first and second data inputs is selected from at least one sequence of data input values having a linear progression.

38. The resolution control system according to claim 26, where the second voltage output has constant ratio steps.

39. The resolution control system according to claim 26, where at least one of the first DAC and second DAC comprises at least one integrated circuit (IC) chip.

40. A method for controlling the resolution in a display device, comprising:

dividing a reference voltage into coarse voltages;

selecting one of the coarse voltages as a first output voltage in response to a first data input value;

dividing the first output voltage into fine voltages;

selecting one of the fine voltages as a second output voltage in response to a second data input value; and controlling an operating parameter of the display device in response to the second output voltage.

41. The method according to claim 40, where the first and second data input values are responsive to the operating parameter.

42. The method according to claim 40, further comprising selecting the first and second data input values from data input values having a linear progression.

43. The method according to claim 40, further comprising selecting the first and second data input values in response to an input signal from at least one of a light sensor user interface.

44. The method according to claim 40, where the second output voltage has constant ratio steps.

45. The method according to claim 40, where the operating parameter is one of brightness and contrast.

46. The method according to claim 40, where the operating parameter is responsive to a luminance value.

47. The method according to claim 46, where the luminance value is in the range of about 0.5 nits through about 400 nits.

* * * * *